United States Patent [19]

Salmon

[11] 3,977,617

[45] Aug. 31, 1976

[54] FILM WINDING AND PERFORATING APPARATUS

[76] Inventor: Marion B. Salmon, P.O. Box 12322, Oklahoma City, Okla. 73112

[22] Filed: July 12, 1973

[21] Appl. No.: 378,645

[52] U.S. Cl. ..... 242/56.8; 83/347; 83/659; 242/58; 242/65; 242/68; 242/68.4; 242/75.41

[51] Int. Cl.² ..... B65H 17/06; B65H 23/08; B65H 35/08

[58] Field of Search ..... 242/56.8, 56.9, 65, 242/67.3, 75.41, 75.51, 58, 58.6, 68; 83/346, 347, 678, 659, 698, 302, 407, 408

[56] References Cited

UNITED STATES PATENTS

| | | | |
|---|---|---|---|
| 947,100 | 1/1910 | Fuller | 83/346 |
| 1,575,758 | 3/1926 | Hasler | 242/68 |
| 1,669,999 | 5/1928 | Olsen | 83/346 X |
| 1,779,562 | 10/1930 | Scusa | 242/56.8 |
| 2,039,472 | 5/1936 | Wood | 242/75.41 |
| 2,042,919 | 6/1936 | Wood | 242/75.41 X |
| 2,266,995 | 12/1941 | Schultz et al. | 242/56.8 X |
| 2,508,566 | 5/1950 | Dunton | 242/58.6 |
| 2,575,062 | 11/1951 | Merwin | 242/68 X |
| 2,915,257 | 12/1959 | Bruns | 242/78.6 |
| 3,117,048 | 1/1964 | Rechel | 242/75.41 X |
| 3,219,206 | 11/1965 | Cocker | 242/67.3 R X |
| 3,357,651 | 12/1967 | Robinson | 242/65 |
| 3,391,876 | 7/1968 | Dalglish | 242/56.9 |
| 3,415,148 | 12/1968 | O'Brien | 83/302 |
| 3,430,560 | 3/1969 | Nettleman | 83/347 |
| 3,564,219 | 2/1971 | Mutziger | 242/75.51 X |
| 3,582,010 | 6/1971 | Whiteman | 242/58 |
| 3,718,298 | 2/1973 | Lucas | 242/67.3 R X |
| 3,734,307 | 5/1973 | Degelleke et al. | 242/65 X |
| 3,768,801 | 10/1973 | Maynard et al. | 83/346 X |

*Primary Examiner*—Stanley N. Gilreath
*Assistant Examiner*—John M. Jillions
*Attorney, Agent, or Firm*—Laney, Dougherty, Hessin & Fish

[57] ABSTRACT

Apparatus for unwinding synthetic resin film from large mill rolls of such film, and concurrently winding the film in a product roll for purposes of marketing, after transversely perforating the film at spaced intervals along its length to form a series of detachably interconnected sheets of film. The apparatus includes means for automatically feeding mill rolls to the unwinding mechanism of the apparatus, means for optionally automatically or manually braking the rotary motion of a rotating, unwinding mill roll with a braking force of a magnitude correlated to the constantly changing diametric size of the unwinding mill roll, and means for automatically counting, in a precise fashion, the number of sheets of the film formed in the wound product roll defined by pairs of adjacent perforations therein. The apparatus further includes novel scoring and perforating means for transversely perforating the film as it moves between the unwinding mill roll and the wound product roll, and means for concurrently and independently unwinding film from a pair of mill rolls.

13 Claims, 12 Drawing Figures

FILM WINDING AND PERFORATING APPARATUS

BACKGROUND OF THE INVENTION

1. Field of the Invention

This invention relates to mechanisms for converting large mill rolls of synthetic resin or plastic films to product rolls of the film after it has been perforated by forming a plurality of perforations or score lines extending transversely across the film and spaced along its length.

2. Brief Description of the Prior Art

Various types of machines have heretofore been provided for the purpose of unwinding elongated strips or bands of synthetic resin films from large rolls of this material in which the film is stored after being produced by the manufacturer. The film thus unwound is generally placed in a more marketable condition for acquisition by the consumer or ultimate user, and this so-called conversion of the film is frequently in the form of winding the film upon product rolls and slitting, perforating or performing some other operation upon the film as it passes between the large mill roll and the product roll. One type of machine which has been used to perform these functions has a cutting bar which carries a plurality of serrated teeth, and which scores or perforates the film at spaced intervals along its length so as to provide a series of interconnected sheets which can be severed in increments from the film by tearing along the score or perforation lines as the film is unwound by the user from the product roll. The cutter bar thus provided has required relatively frequent replacement, and is difficult and time consuming to install. Moreover, it is susceptible to undesirable misalignment over its length so that the perforating function carried out by this structural element is not uniform across the transverse dimension of the film which is perforated.

The machines previously in use for unwinding mill rolls and producing perforations at spaced intervals along the length of the film have generally been manually fed machines in which it is necessary to manually locate and position a new mill roll at the unwinding position after a preceding mill roll has been unwound and has been removed from the machine. This manual placement is difficult because the mill rolls are frequently very heavy and bulky, and often must be elevated to a relatively high position within the machine in order to provide a readiness status for unrolling.

Difficulties have also been encountered with many of the types of converting apparatus previously used for unwinding mill rolls and perforating the film, in that the wind which is performed in producing the product roll is not uniform, and there is considerable wastage entailed as a result of wrinkling or failure to achieve a smooth, even transfer to the product roll. A portion of this difficulty has resulted from attempts to achieve a uniform braking effect on the unwinding mill roll by braking a central shaft upon which the mill roll is mounted, and with which it moves in rotation. Attempts to achieve braking of the mill roll in this fashion have been ineffective to achieve constant and uniform braking over the unwinding period since the inertial force of the mill roll varies as its diameter changes during the unwinding operation, and an attempt to brake the roll by drag forces applied to the rotating shaft upon which it is mounted has caused a variation in the rate of unwinding, and consequently in the rate in which the film is taken up on the product roll.

Another problem which has been frequently encountered in converter machines of the type under discussion is that of obtaining an accurate count of the number of sheets in the product roll as such sheets are defined by adjacent perforations formed transversely in the film during its course of travel from the mill roll to the product roll. The inaccuracy in the counting or identification of the number of sheets in a product roll has sometimes arisen from the attempt to make such count by counting the number of revolutions of the product roll as the film is taken up thereon. As has been pointed out, the product roll does not turn at uniform speeds at all times during the winding up of the film thereon, nor is the film transferred at a constant speed during the entire period of transfer from the mill roll to the product roll. Also, the size of each succeeding convolution of rolled up film is larger than the last preceding convolution. These factors induce error in any attempt to accurately count the number of sheets formed in the film by counting revolutions of the shaft upon which the product roll is mounted. Therefore, an indication of the number of sheets contained in a product roll is generally taken only as an approximation, with a margin of error always being recognized.

More often, the problem of sheet count arises when a first count is made on the basis of lineal feet of film going into the product roll, and then attempting to mathematically convert this figure to the number of sheets in the product roll.

Situations are frequently encountered in the conversion of plastic film from mill roll to product roll of desiring to run, simultaneously, a pair of relatively short length mill rolls, and to take up the film from these two mill rolls on two separate product rolls. This has been attempted with several machines by mounting the mill rolls for concurrent rotation on a common shaft to which the mill rolls are keyed, and with which they therefore rotate. The inherent variation in the speeds with which the film will be taken off the two mill rolls and transferred to the two product rolls results in an uneven distribution of the film on the two product rolls, some wrinkling and some wastage of film. To my knowledge, no attempt has been made to the present time to provide for independent rotation of the two concurrently unwound mill rolls so that the independent and differing unwinding forces transferred to each of these rolls in the course of unwinding is automatically compensated by the ability of each roll to move at an independent rate of rotation.

BRIEF DESCRIPTION OF THE PRESENT INVENTION

This invention provides a synthetic resin film winding and perforating apparatus which is more versatile in its usages than previous machines of this general type, and which operates more efficiently in producing less wastage of film, and neater, more accurately made-up product rolls of film.

Broadly described, the invention comprises a framework, a cutter roll mounted on the framework and carrying adjustable cutting means thereon for transversely perforating film passed thereover, a backup roll extending parallel to the cutter roll and having a yielding outer peripheral surface bearing against the outer peripheral surface of the cutter roll, and a rotatably supported take-up sleeve or core detachably mounted on the framework for winding up film unwound from the mill roll.

The novel cutter roll and backup roll subassembly included in the apparatus includes a plurality of aligned blade members which are individually radially adjustable relative to the cutter roll and extend axially along the outer peripheral surface of the cutter roll. The backup roll has a peripheral covering of multiple layers of synthetic resin which receive the cutting edges of the blade members during rotation of the cutter roll.

Another important subassembly employed in the apparatus of the present invention is a mill roll drag braking assembly. This assembly includes a flexible friction sheet or panel which is supported to frictionally bear against the periphery of the mill roll as it unwinds. There is also provided as a portion of the drag braking assembly, means for increasing the tension in the flexible friction panel to increase its braking effect on the rotating mill roll.

The winding and perforating apparatus of the invention further includes an automatic mill roll pickup and feeder assembly which functions in conjunction with a mill roll supply frame to automatically pick up and position for unwinding, a plurality of full mill rolls in a sequential operation.

In a preferred embodiment of the invention, a novel swing arm assembly is provided and used in combination with a product roll assembly which includes the cylindrical take-up sleeve or core. The swing arm assembly functions to move the product roll assembly between a first position, from which an empty sleeve or core may be easily placed into the machine, or a fully wrapped product roll removed therefrom, and a second position, in which the sleeve or core is in a wrapping position ready to be wrapped with film transferred from one or more mill rolls. Another assembly which is included in preferred embodiments of the invention is a sheet counting assembly. The sheet counting assembly includes revolution indicating means carried on the cutter roll used to perforate the film, and sensing means mounted on the framework of the machine in a position adjacent the cutter roll, and the revolution indicating means carried thereon, and cooperating with the revolution indicating means to develop a signal upon each revolution of the cutter roll. Finally, the sheet counter assembly includes a counter or readout device connected to the sensing device for portraying, at any instant during the operation of the apparatus, an accurate count of the number of sheets which have been formed in the film by the perforating operation.

The invention, in addition to various novel subcombinations described, is directed to the general structural combination utilized. This combination includes means for positioning a mill roll in an unwinding position, means for winding film from the mill roll upon a product roll, means guiding film from the mill roll through a pre-determined path, means along said pre-determined path for scoring the film with transverse perforation lines, and means for braking the film travel from the mill roll toward the product roll in automatic response to changes in mill roll angular momentum.

The film winding and perforating apparatus, as thus constituted, allows a number of objectives and advantages to be achieved. A partial listing of these includes:

Better control of the unwinding of film from the mill roll is achieved by the maintenance, through automatically controlled braking, of the speed at which the film is unwound and moves through the machine to the product roll;

Longer service life of the cutter roll, and more uniform and effective perforation of the synthetic resin film by the cutter roll;

Easier and more expeditious mounting or dismantling of the cutter roll and backup roll used for film perforation when these rolls must be replaced or repaired;

Ability to simultaneously unwind two mill rolls which may be of the same or differing lengths, and simultaneously perforate and rewind the film from rolls in two product rolls;

Ability to attain continuous accurate counting of the cumulative total number of sheets which have been formed in the film at any time by perforating the film along transverse score lines;

Easier and better controlled introduction of empty product roll spools or cores into the apparatus for receiving film, or removal of finished product rolls from the apparatus;

Continuous and automatic feeding of a plurality of mill rolls into the apparatus for sequential unwinding of the mill rolls; and Provision of a stand-by film roll in an auxiliary feeding position for wrapping the backup roll, or for providing an alternate film source for forming product rolls.

Additional objects and advantages of the invention will become apparent as the following detailed description of the invention is considered in conjunction with the accompanying drawings which illustrate the invention.

BRIEF DESCRIPTION OF THE DRAWINGS

FIG. 8 is a vertical sectional view taken along line 8—8 of FIG. 4 and showing in detail, portions of the product roll assembly.

FIG. 9 is a detail view, with parts shown in elevation and parts shown in section, illustrating the manner in which two short length mill rolls are mounted in the apparatus for simultaneous, independent passage through the apparatus to two product rolls.

DETAILED DESCRIPTION OF A PREFERRED EMBODIMENT OF THE INVENTION

Main Frame and Mill Roll Supply Frame

Figure 1:
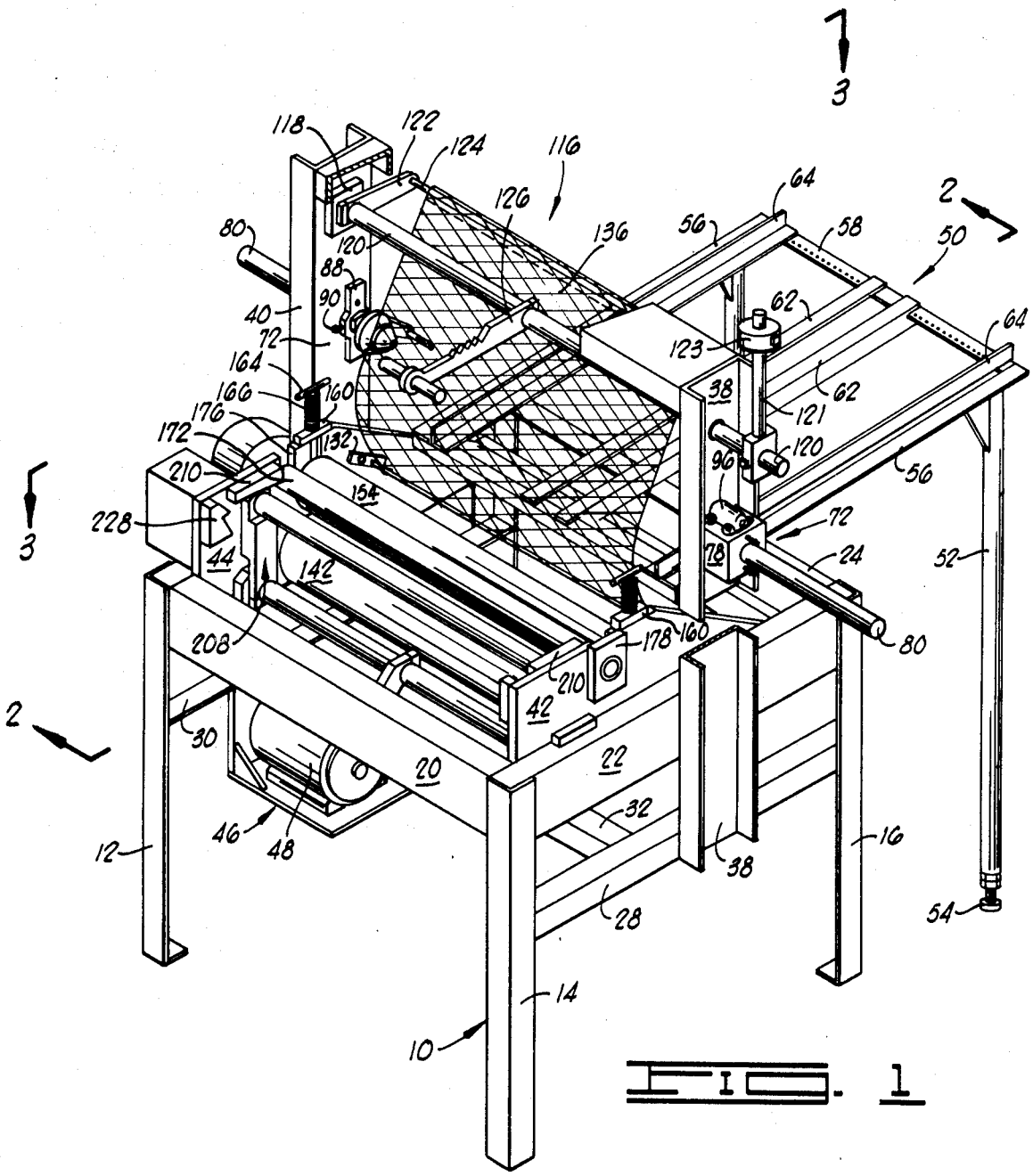
FIG. 1 is a perspective view of the film winding and perforating apparatus of the invention.

Referring initially to FIG. 1 of the drawings, the film winding and perforating apparatus of the invention includes an upright main frame 10 which includes four vertically extending frame members 12, 14, 16 and 18 which support the winding and perforating apparatus above a floor or other supporting surface. Horizontal frame members 20, 22, 24 and 26 are provided at the upper side of the frame and interconnect the vertically extending frame members 12–18. Intermediate frame members 28 and 30, along with cross beams 32 and 34, complete the frame.

Projecting upwardly on opposite sides of the frame and having their lower ends secured to the horizontal frame members 22 and 26 and to the intermediate frame members 28 and 30 are a pair of large channel members 38 and 40. The channel members 38 and 40 provide primary supporting structure for certain operating elements of the winding and perforating apparatus as hereinafter described. Secured to the inner sides of the horizontal frame members 22 and 26 are a pair of generally trapezoidally shaped, vertically extending roll supporting plates 42 and 44. Adjustably suspended on the horizontal frame member 30 is a motor supporting bracket designated generally by reference numeral 46. The motor supporting bracket 46 supports, at one side of the main frame 10, a motor 48 used to supply power to the winding and perforating apparatus of the invention.

A mill roll supply frame, designated generally by reference numeral 50, is positioned on one side of the main frame 10 and includes a pair of vertically extending posts 52 having supporting feet 54 adjustably threaded into the lower end of the posts so that the distance which the posts project above the floor or other supporting surface can be individually and selectively adjusted for purposes of leveling, and also adjusting the total height of the mill roll supply frame. At the upper ends of the posts 52, the posts are each connected to a pair of outside frame plates 56 which are inclined with respect to the horizontal so that their lower ends project over the horizontal frame member 24 of the main frame and terminate at a location substantially aligned with the channel members 38 and 40. The outer ends of the outside frame plates 56 are interconnected by a transversely extending, elongated perforated angle plate 58. At the opposite side of the mill roll supply frame 50, a second elongated, perforated angle plate 60 interconnects the inner ends of the outside frame plates 56.

A pair of central, elongated roll supporting angle plates 62 extend between the central portions of the elongated, perforated angle plates 58 and 60. Spaced outwardly on the mill roll supply frame 50 from the elongated roll supporting angle plates 62, and extending parallel to the roll supporting angle plates are a pair of roll guiding angle plates 64. As will be hereinafter explained, the roll guiding angle plates 64 are adjustably secured at their opposite ends to the elongated, perforated angle plates 58 and 60 so that they can be adjusted in their transverse spacing from each other and from the elongated roll supporting angle plates 62 in order to accommodate mill rolls of differing lengths on the mill roll supply frame 50. Extending transversely across the mill roll supply frame 50 is a slope adjusting angle plate 66 (see FIG. 2) having end portions secured to the undersides of the outside frame plates 56, and having its opposite ends adjustably secured to threaded adjustment bolts 68 mounted on the horizontal frame members 22 and 26. Through the use of the adjustment bolts 68, the vertical elevation of the inner end of the mill roll supply frame 50 above the floor or other supporting surface can be adjusted so as to change the inclination of the roll supporting plates 62 and roll guiding plates 64 with respect to the horizontal.

Mill Roll Pickup and Feeder Assembly

Figure 4:
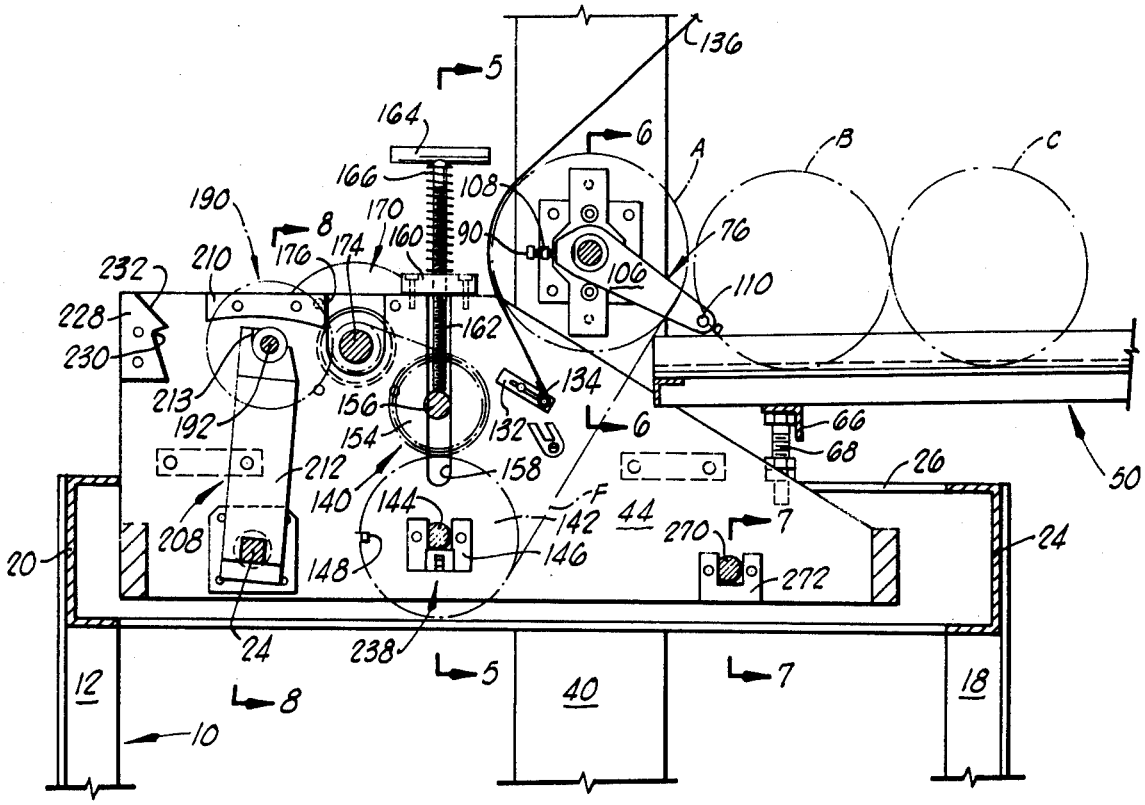
FIG. 4 is a sectional view similar to FIG. 2 showing a portion of the apparatus in detail, and illustrating the various rolls, including mill rolls, product roll, cutter roll and backup roll in dashed lines.
Figure 6:
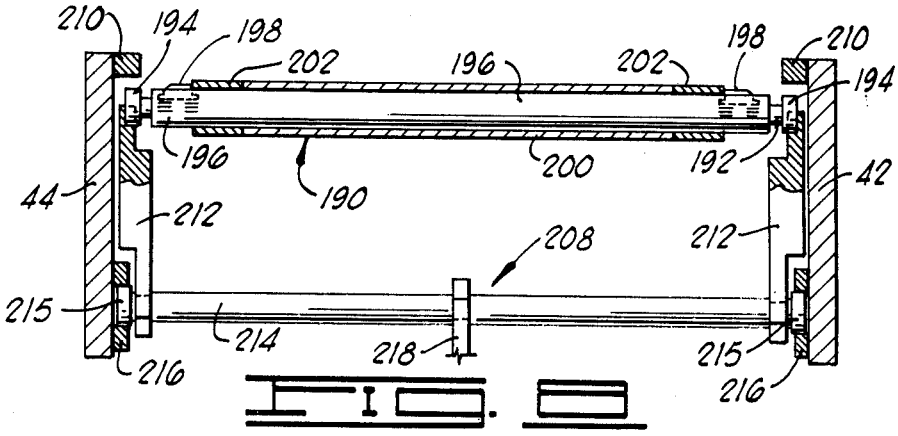
FIG. 6 is a vertical sectional view taken along line 6—6 of FIG. 4.
Figure 5:
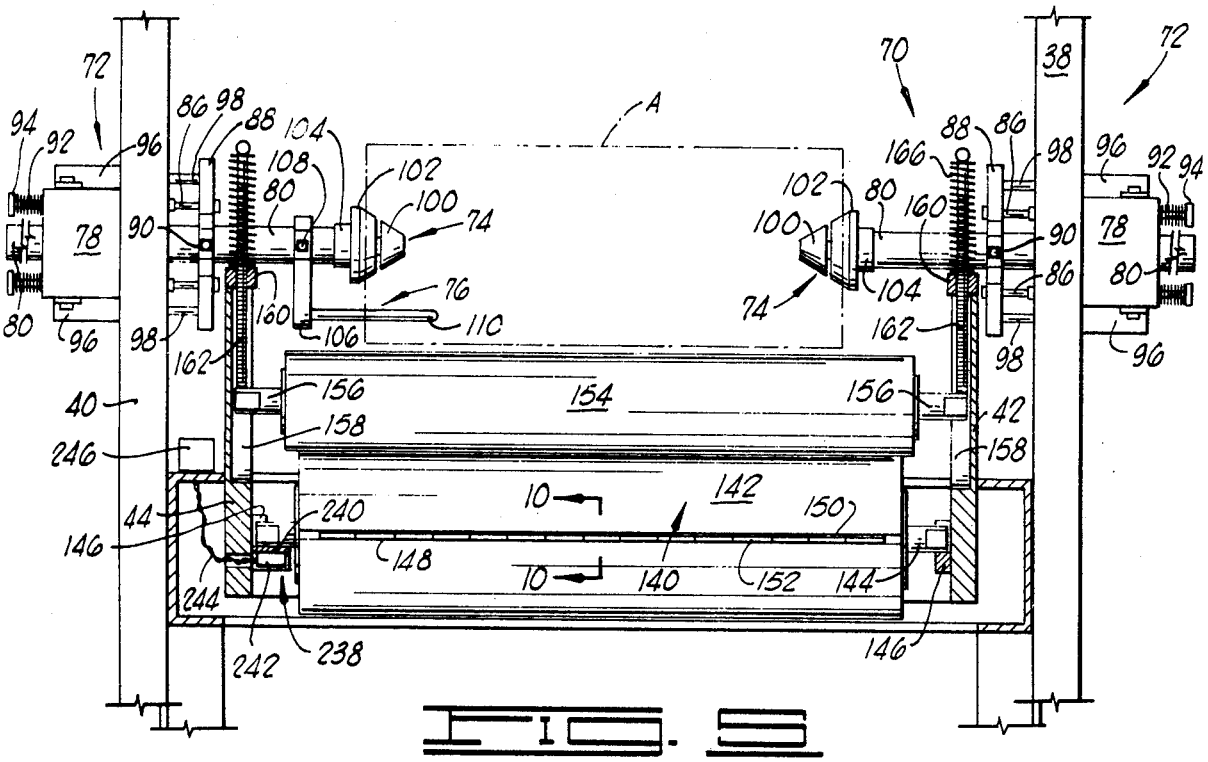
Figure 6:
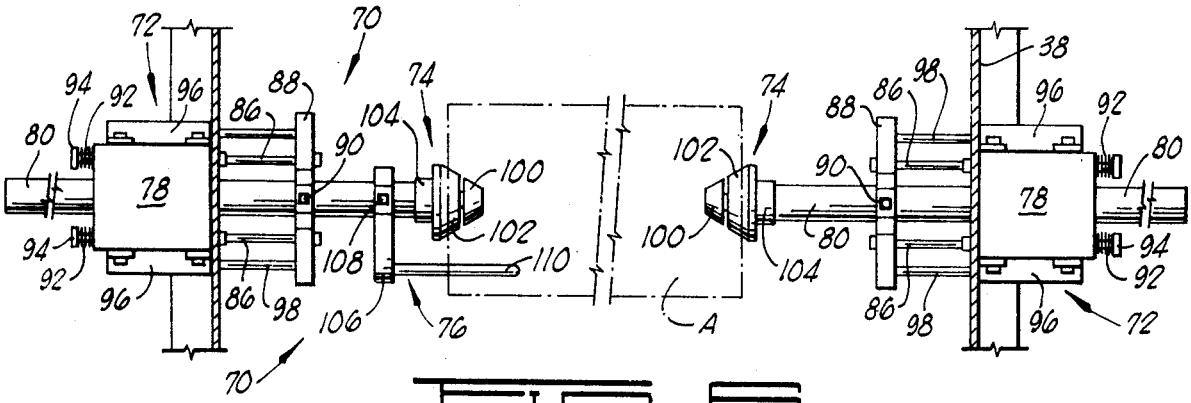

A mill roll pickup and feeder assembly, designated generally by reference numeral 70, is mounted on the channel members 38 and 40. This assembly is best illustrated in FIGS. 1, 4 and 6. The mill roll pickup and feeder assembly 70 includes a pair of air chuck subassemblies, designated generally by reference numeral 72, a pair of spinner subassemblies, designated generally by reference numeral 74, and a mill roll stop structure designated generally by reference numeral 76.

Considering first the air chuck subassemblies 72, each of these subassemblies includes a bearing block 78 secured to one of the respective channel members 38 or 40, and having a central bore therethrough lined with a bronze bushing for the accommodation of a roll supporting shaft 80. The roll supporting shafts 80 are each slidably mounted within the bearing blocks 78 for a purpose hereinafter described, and pass through apertures in the respective channel member 38 or 40.

A pair of bores, formed on the opposite sides of the bore which accommodates the shaft 80, are drilled partially through the bearing block 78 from the outer side thereof, and each communicates with a counterbore extending the remainder of the way through the block 78 on the inner side thereof. A pair of spring shafts 86 are slidably mounted within the counterbores and project through each bearing block 78 and through the respective channel member 38 or 40. The inner ends of the spring shafts 86 are secured to a flat, generally vertically extending locking plate 88 which is centrally apertured to accommodate extension therethrough of the respective roll supporting shaft 80. The locking plate 88 in each of the air chuck subassemblies 72 is provided with a threaded set screw receiving aperture extending from an outer side thereof into communication with the central aperture through which the respective roll supporting shaft 80 is passed, so that a set screw 90 may be used for locking the respective locking plate in a selected position along the length of the respective roll supporting shaft for a purpose hereinafter described. Positioned around each of the spring shafts 86, with one end bearing against the shoulder formed internally of the bearing block 78 at the intersection of the bore with the counterbore, is a helically wound return spring 92. Each of the return springs 92 projects out of the respective bore and bears against a suitable stop 94 formed on the outer end of the respective spring shaft 86.

Mounted at the upper and lower side of each bearing block 78 are a pair of air cylinders 96. Each of the air cylinders encloses a piston (not shown) and the inner end of a piston rod 98 which has its outer end secured to the locking plate 88. Air under pressure is supplied to each of the air cylinders 96 in each air chuck assembly 72 from a suitable source (not shown), and the actuation of these air cylinders is synchronized so that the piston rods 98 of each air chuck assembly are extended simultaneously and at the same rate of extension so that the locking plate 88 may be projected horizontally inwardly, or retracted outwardly, with respect to the main frame 10, and particularly, with respect to the channel members 38 and 40, for a purpose hereinafter described.

The two spinner subassemblies 74 constituting a further sub-combination within the mill roll pickup and feeder assembly 70 are provided in association with each of the two air chuck assemblies 72. Each of the spinner assemblies 74 includes a spinner cone 100 of frustoconical configuration, and adapted to be wedgingly inserted into the cylindrical core of a mill roll in a manner and for a purpose hereinafter described. Each spinner assembly 74 further includes a spinner 102, also of generally frustoconical configuration, and sized and configured to coincide with the projection toward the base thereof of the cone of which the adjacent spinner cone 100 constitutes a frustum section. Each spinner 102 is mounted for rotation on a locking collar 104 secured to the respective roll supporting shaft 80, and the spinner cone 100 is secured by a suitable bolt to the inner end of the roll supporting shaft. Stated differently, the spinner 102 in each of the spinner assemblies 74 can rotate on its respective roll supporting shaft 80.

Figure 5:
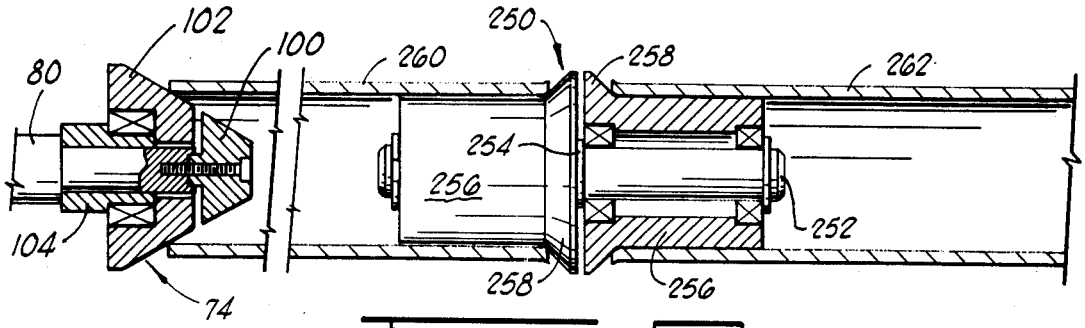
FIG. 5 is a vertical sectional view taken along line 5—5 of FIG. 4.

The mill roll stop structure 76 forming a part of the mill roll pickup and feeder assembly 70 is, as illustrated in FIG. 5, mounted between the spinner assembly 74 carried on the inner end of the roll supporting shaft 80 which projects through the channel member 40 on one side of the main framework 10. The mill roll stop structure 76 includes a mill roll stop arm 106 which is secured on the roll supporting shaft 80, and projects at a selected angle with respect to the axis of this shaft by means of a set screw 108 which projects through a heel portion of the mill roll stop arm and bears against a flat formed on the shaft 80. It will be noted in referring to FIG. 4 that the mill roll stop arm 106 projects generally in the direction of the mill roll supply frame 50, and downwardly with respect to the roll supporting shaft 80. At its free or outer end, the mill roll stop arm 106 carries a horizontally projecting stop pin 110 which projects inwardly with respect to the main framework 10 and passes over one of the roll guiding plates 64 of the mill roll supply frame 50. The purpose and function of the mill roll stop structure 76 in the operation of the winding and perforating apparatus of the invention will be hereinafter explained in greater detail.

Drag Brake Assembly

Mounted above the mill roll pickup and feeder assembly 70, between the channel members 38 and 40, is a drag brake assembly, designated generally by reference numeral 116. The drag brake assembly 116 includes a pair of bearing blocks 118 secured to the inner side of the channel members 38 and 40 near the upper ends thereof. The bearing blocks 118 receive and rotatably accommodate the opposite end portions of a drag brake shaft 120 which projects horizontally between the channel members 38 and 40. One end of drag brake shaft 120 projects through a bearing block 118 and carries a vertically extending counterbalance shaft 121 having a counter-balance weight 123 adjustably mounted thereon. Also, the angular position of the shaft 121 with respect to the axis of the shaft 120 can be selectively adjusted. Keyed from the bearing blocks 118 are a pair of brake arms 122 which project in a generally horizontal direction from the drag brake shaft and extend above the inner end of the mill roll supply frame 50. The free ends of the brake arms 122 spaced outwardly from the drag brake shaft 120 receive the opposite end of an upper brake rod 124.

An elongated hand lever 126 has one of its ends keyed to the drag brake shaft 120 at the center thereof and has a hand grip 128 secured to its opposite end. At an intermediate portion of the hand lever 126 between the hand grip 128 and the drag brake shaft 120, a plurality of teeth or serrations 130 are formed in the upper side of the hand lever for the optional accommodation of suspended braking weights for a purpose hereinafter described.

Figure 2:
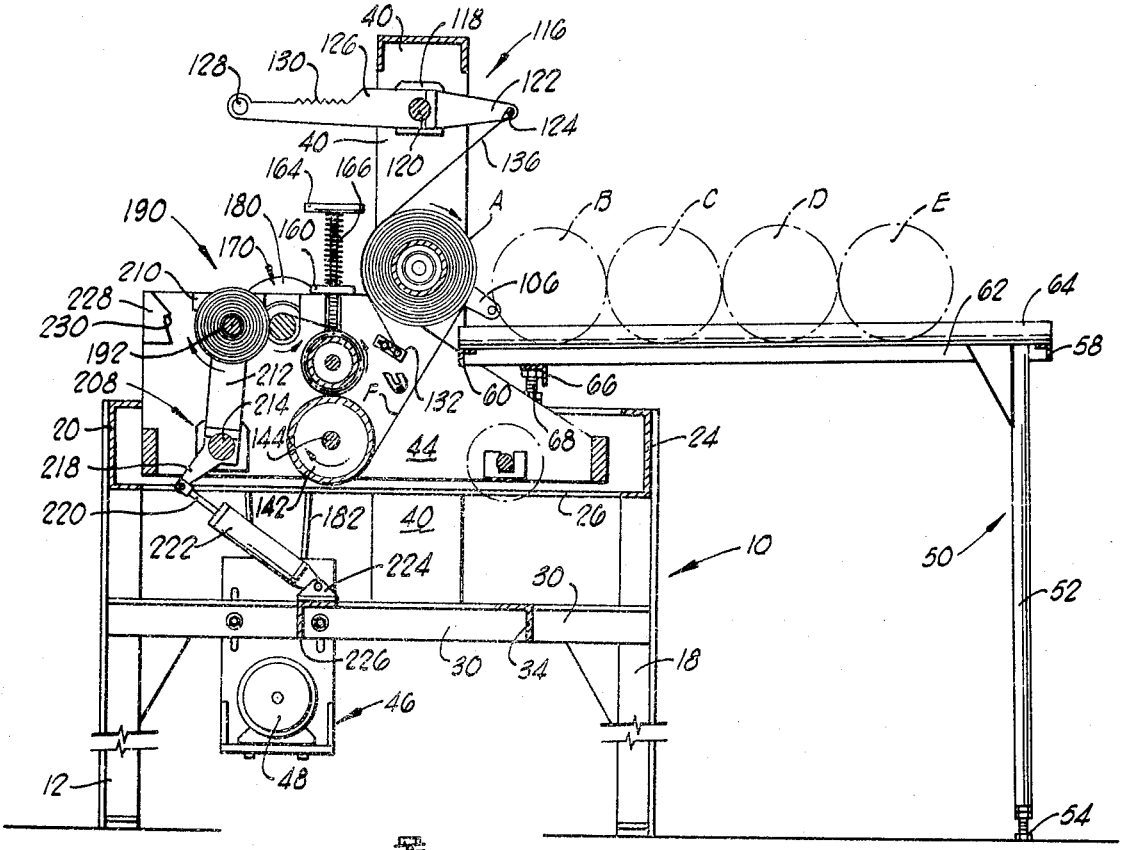
FIG. 2 is a vertical sectional view of the film winding and perforating apparatus of the invention taken along line 2—2 of FIG. 1, but showing a mill roll and product roll in place, and showing stand-by rolls in dashed lines.
Figure 3:
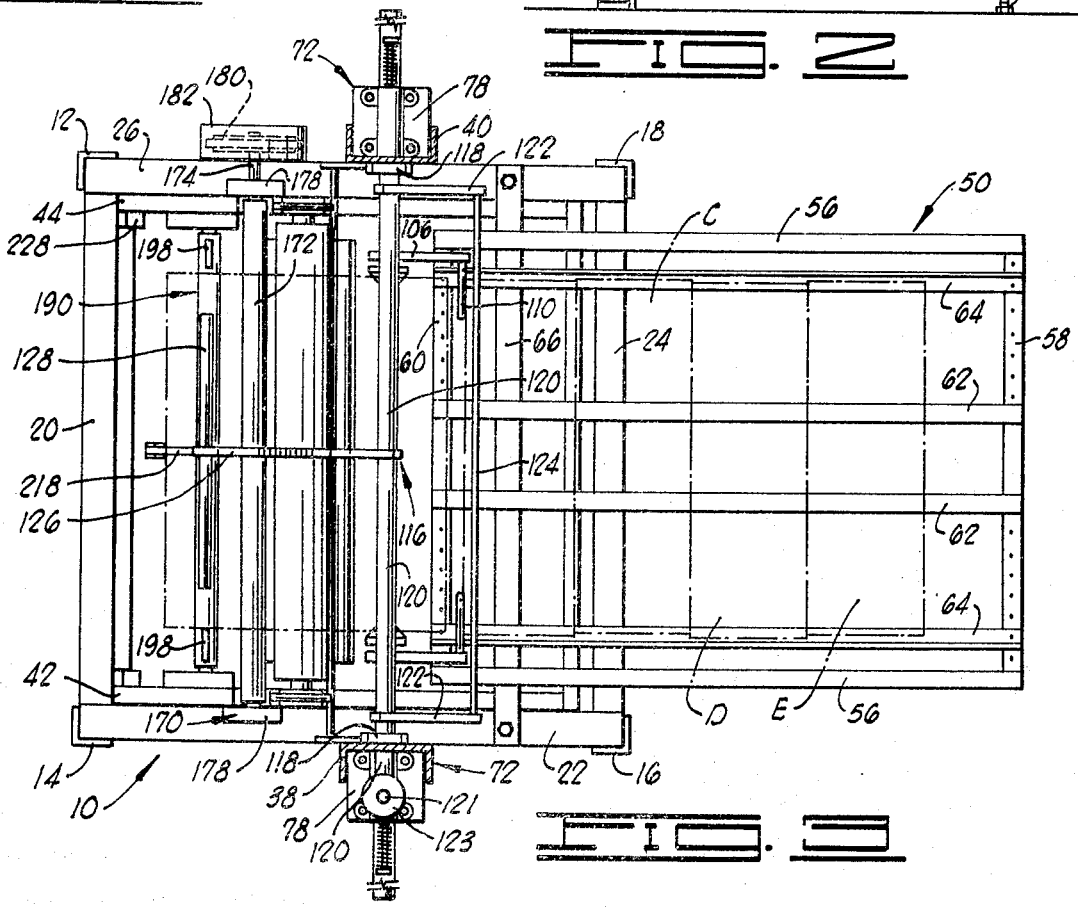
FIG. 3 is a horizontal sectional view of the film winding and perforating apparatus taken along line 3—3 of FIG. 1, showing the stand-by mill rolls, braking skirt and product roll in dashed lines.

Adjustably attached to the inner faces of the two trapezoidally shaped roll supporting plates 42 and 44 are a pair of lower brake rod supporting brackets 132. The lower brake rod supporting brackets receive and support the opposite ends of an elongated lower brake rod 134. The lower brake rod 134 projects horizontally between the roll supporting plates 42 and 44 at a location below the air chuck subassemblies 72 as best illustrated in FIG. 1, 2 and 3. A flexible braking panel 136, made of fabric or other suitable material, is extended between the upper brake rod 124 and the lower brake rod 134 so that its upper edge is connected to the upper brake rod and its lower edge is connected to the lower brake rod, with a catenary or bight formed in the flexible braking panel between its rod secured edges. Adjustment of the depth of this bight or catenary can be attained by adjustment of the position of the lower brake rod supporting brackets 132 which are adjustably mounted on the roll supporting plates 42 and 44.

Film Perforating Assembly

A film perforating assembly is mounted between the trapezoidally shaped roll supporting plates 42 and 44 on the opposite side of the lower brake rod 134 from the mill roll supply frame 50. The perforating assembly includes a cutter drum or roll 142 which is rotatably mounted on a supporting shaft 144 which extends transversely across the main framework 10 and has its opposite ends, formed with flats thereon, supported in suitable supporting brackets 146 secured to the inner sides of the roll supporting plates 42 and 44. The cutter roll 142 is preferably formed of aluminum or other hard material and has formed thereon, a slot 148 which extends from one end thereof to the other on the outer periphery of the cutter roll and projecting substantially parallel to the rotational axis thereof.

Figure 10:
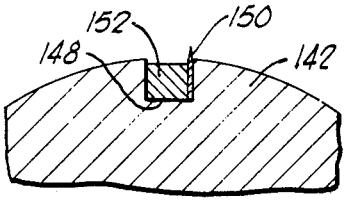
FIG. 10 is a sectional view taken along line 10—10 of FIG. 5 and illustrating the manner in which the blade elements are mounted in the cutter roll.
Figure 11:
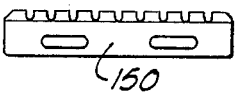
FIG. 11 is an elevation view of one of the blade elements employed on the cutter roll for perforating the film.

Mounted in the slot 148 on the cutter roll 142 are a plurality of longitudinally aligned perforating blades or elements 150 of the type shown in FIG. 11. Each of the perforating blades 150 has a serrated or notched upper cutting edge which facilitates the perforation of film passed thereover in a manner hereinafter described. The several aligned perforating blades 150 mounted in the slot 148 are retained in the slot by the use of a plurality of wedge or shim blocks 152 which can be made of lead, steel or wood, and which are driven into the slot 148 after the perforating blades 150 are positioned therein to retain the perforating blades in the position within the slot shown in FIGS. 5 and 10.

Mounted in the main framework 10 for rolling cooperation with the cutter roll 142 is a backup drum or roll 154. The backup roll 154 is preferably constructed so that a radially outer portion thereof consists of a layer or coating of cork or hard rubber. This material is wrapped about by a plurality of wraps of a synthetic resin film of the type which is relatively tacky, in the sense of the several wraps adhering to each other when wrapped tightly about the periphery of the backup roll. The backup roll 154 is rotatably mounted by means of suitable bearings on a shaft 156 which has its opposite end portions flatted, and these end portions received in a deep, vertically extending recess or channel which projects downwardly into each of the roll supporting plates 42 and 44 from the upper side thereof.

A threaded tension block 160 is bolted across and closes the open upper end of each of the channels 158 in the two roll supporting plates 42 and 44, and by means of the threaded bore through the center thereof, accommodates the threaded shaft of an elongated, manually adjustable tension screw 162. Each of the tension screws 162 has a handle 164 at the upper end thereof, and further has a compression spring 166 positioned between the handle and the tension block 160 around the shaft of the tension screw. It will be perceived in referring to FIGS. 2, 4 and 5 of the drawings that the lower end of each of the tension screws 162 bears against the upper side of the shaft 156 carrying the backup roll 154, and that the backup roll is prevented from moving vertically by contact of its shaft with the lower end of these tension screws.

Power Roll Assembly

A power or drive roll assembly 170 is mounted in the main framework 10 between the upper sides of the roll supporting plates 42 and 44, and on the opposite side of the cutter roll 142 and backup roll 154 from the mill roll pickup and feeder assembly 70. The power roll assembly 170 includes a power roll or drum 172 which is keyed to a power shaft 174 which projects through openings 176 formed in the roll supporting plates 42 and 44 and into a pair of power shaft bearing blocks 178 mounted on the outer sides of the roll supporting plates 42 and 44. The power shaft 174 is journaled for rotation in the power shaft bearing blocks 178, and one end of the shaft projects outwardly of its respective bearing block 178 and carries a pulley 180 (see FIG. 3). The pulley 180 is housed in a suitable shield structure 182 and engages a drive belt 182 which is driven from the motor 48.

Product Roll Assembly

A product roll assembly, designated generally by reference numeral 190, is mounted on the main frame 10 at the side thereof opposite the side which is adjacent the mill roll supply frame 50. The product roll assembly 190 includes an elongated shaft 192 which is journaled in a pair of shaft bearings 194 at its opposite ends, and which has a cylindrical sleeve 196 keyed to the shaft for rotation therewith and secured around the outer periphery of the shaft over a major portion of its length. The cylindrical sleeve 196 is radially recessed or slotted at points adjacent its opposite ends to accommodate spring biased retainer keys 198 which project out of the peripheral outer surface of the sleeve 196, and are provided for a purpose hereinafter described in greater detail. The product roll assembly 190 further includes a cylindrical roll core 200, which may be made of cardboard or other suitable material, and which is concentrically positioned around the cylindrical sleeve 196 and may be of various lengths. In some uses of the product roll assembly 190, this assembly will further include a pair of short spacer sleeves 202 positioned around the cylindrical sleeve 196 at a location between the retainer keys 198 and the cylindrical roll core 200.

Swing Arm Shaft Assembly

For the purpose of easily implacing and removing the product roll assembly as product rolls of perforated film are prepared using the apparatus of the invention, a swing arm shaft assembly 208 is provided. The swing arm shaft assembly 208 includes a pair of product roll guide plates 210 which are mounted on the inner sides of the two trapezoidally shaped roll supporting plates 42 and 44 at the upper side thereof, as best illustrated in FIGS. 3 and 4. The product roll guide plates 210 function to prevent upward movement of the product roll assembly 190 as it is moved in a swinging or oscillating movement from a running film take-up position, illustrated in FIG. 2, to a roll insertion or removal position hereinafter described.

The swing arm shaft assembly 208 further includes a pair of swing arms 212 mounted adjacent the inner side of the two opposed roll supporting plates 42 and 44. The geometric configuration of the swing arms 212 can be best perceived by reference to FIGS. 4 and 8 of the drawings. It will be noted that each of the swing arms 212 is relatively elongated in shape, and that each is provided at its upper end with an arcuate, generally semi-circular slot which accommodates one of the shaft bearings 194 of the product roll assembly. The arcuate slots receiving the shaft bearings 194 are open at the upper sides to permit the product roll assembly to be placed within, and removed from, the swing arms 212 during different phases of the operation of the winding and perforation apparatus of the invention. When the swing arm shaft assembly 208 carries the product roll assembly 190 into the windup position, depicted in FIG. 2, however, the shaft bearings 194 are prevented from moving up out of the arcuate slots formed in the top side of the swing arms 212 by the product roll guide plates 210 which are then in a position immediately above the upper ends of the two swing arms.

The lower ends of the swing arms 212 are keyed to opposite ends of a swing arm shaft 214 which projects transversely in the main frame 10, and which has its opposite ends received in suitable journal blocks 215 carried by brackets 216 secured on the inner faces of the roll supporting plates 42 and 44. A cylinder lever 218 is keyed to the swing arm shaft 213 at a central portion thereof and projects radially from the swing arm shaft in a generally downwardly direction. The opposite end of the cylinder lever 218 from its end connected to the swing arm shaft 213 is pivotally connected to the outer end of a piston rod 220 which projects outwardly from a power cylinder 222. The power cylinder 222 can be either hydraulically or penumatically actuated. The cylinder 222 is pivotally mounted to the main frame 10 through a suitable bracket 224 secured on the upper side of an angle member 226 extending transversely across the main frame 10 between the intermediate frame members 28 and 30 (see FIG. 2).

The final elements of the swing arm shaft assembly 208 are a pair of stop plates 228 which are mounted on the inner side of the roll supporting plates 42 and 44, and are spaced horizontally from the product roll guide plates 210. The configuration of the stop plates 228 is such that each carries a notch 230 in one side thereof to accommodate the upwardly projecting finger formed at the upper end of the respective swing arms 212, and to provide an inclined guide surface 232 for guiding the shaft bearings 194 of the product roll assembly into the arcuate slots formed in the upper side of the two swing arms 212 at the time when a new product roll assembly is being placed in the apparatus preparatory to forming a new product roll.

Sheet Counting Assembly

For the purpose of providing an accurate count of the number of sheets which are formed by perforating the film being transferred from a mill roll to a product roll, a sheet counting assembly 238 is provided in the apparatus of the invention. It will be understood from the foregoing discussion of the invention that the term "sheets" as used in this disclosure refers to that segment of the elongated film between the ends thereof which is defined between adjacent perforation lines which are scored or cut transversely of the film at longitudinally spaced intervals therealong by the film perforating assembly 140 hereinbefore described.

The sheet counting assembly 238 includes a photocell housing 240 which is mounted on the inner face of the roll supporting plate 44 at a location which is in close proximity to the supporting bracket 146 forming a portion of the film perforating assembly, or it may even be an integrally formed part of the supporting bracket (as illustrated). The photocell housing 240 is open at its side facing inwardly toward the cutter roll 142, and has mounted on the interior thereof, a photocell 242 which is supplied with power and delivers a read out signal through suitable electric leads 244 passed through an aperture formed in the roll supporting plate 44 in alignment with the interior of the photocell housing. The leads 244 may, in part, be connected to a suitable counter device 246 which functions to visually portray a numerical count indicative of the number of sheets which have been formed in an elongated film being passed through the apparatus of the invention, as such count of these sheets may exist at any given instant. As a final element of the sheet counting assembly, a spot or tab (not shown) of a light reflecting or photosensitive material is placed on the end face of the cutter roll 142 at a radial distance with respect to the axis of rotation of this roll such that the spot or tab will pass through a point of alignment with the photocell 242 once during each rotation of the cutter roll.

Operation of the Primary Systems for SIngle Product Roll Transfer and Perforation Prior to describing certain additional structural elements forming a portion of the film winding and perforating apparatus of the invention, and which are used in certain specialized applications and usages of the apparatus, the general manner in which the apparatus thus far discussed is operated will be described in order to illustrate the manner of functioning of the overall apparatus, and the specific purposes of its various subassemblies. In readying the apparatus for operation, the film perforating assembly is prepared for use. Normally, once the film perforating assembly has been assembled in the manner hereinafter described, it will not be necessary to adjust, reassemble or renew portions of this assembly over extended periods of operation of the apparatus, since many winding and perforating operations involving a number of mill rolls and product rolls can be carried out without such adjustment or renewal.

In making up or preparing the film perforating assembly, the perforating blades or elements 150 are first placed in the slot 148 on the outer periphery of the cutter roll 142 while the cutter roll is removed from the main frame 10. An advantage of the apparatus of the present invention is the ease with which the perforating blades 150 may be mounted in the cutter roll 142, and the facility with which the cutter roll may be transferred into and out of its operating position in the main frame. It will be perceived that all that is required to place the cutter roll 142 in operating position within the main frame 10 is the lowering of the shaft 144 carrying the cutter roll into the supporting brackets 146 located on the roll supporting plates 42 and 44 at the opposite sides of the main frame 10. The flats formed on the shaft 144 will prevent the shaft from turning in the brackets 146, and, as will be hereinafter explained, once the cutter roll is so positioned, it is prevented from vertical movement by the brackets 146 supporting the shaft 144 from below, and by the backup drum or roll 154 bearing against the outer periphery of the cutter roll 142 from above.

With the cutter roll 142 removed from the main frame 10 for purposes of implacing the perforating blades 150 in the slot 148 thereof, these blades are placed in alignment along one side of the slot with the serrated or notched upper edges thereof facing upwardly and projecting radially outwardly beyond the outer periphery of the cutter roll. The blades are then secured tightly in position by means of the shims or wedges 152 in the manner shown in FIG. 10. I have found that providing the perforating cutting structure in the manner described has a distinct advantage over the provision of elongated cutter bars of the type heretofore in use, in that the plurality of individual perforating blades 150 mounted in this way tends to provide a self-compensating cutting edge so that misalignment or failure to perforate evenly across the film as it traverses these blades is avoided. In other words, the blades 150 tend to act individually and to self-compensate for excessive pressures which may act in a localized fashion over the length of the cutter roll 42 over extended periods of operation. Moreover, in the event one of the perforating blades 150 should become damaged or non-functional for any reason, it can be easily replaced in an expeditious manner by quickly removing the cutter roll 142 from its supporting brackets 146 in a manner hereinafter described, and replacing any individual perforating blade which may require renewal.

With the aligned perforating blades 150 securely positioned in the slot 148 on the cutter roll 142 in the manner described, te cutter roll is then returned to its operating position in which its shaft 144 is supported in the supporting brackets 146. At this time, the backup drum or roll 154 has been removed from its operating position in the main frame 10 by removal of the tension blocks 160 bolted to the roll supporting plates 42 and 44 so as to open the upper end of the channels 158 formed in these plates, and allow the backup drum or roll to be lifted out. This, too, constitutes a marked advantage over prior constructions in the ease with which the backup roll may be placed in operating position in the main frame 10, or removed therefrom when it is to be replaced or repaired, or when the cutter roll 42 is to be replaced or repaired.

In preparing the backup drum 154 for use in the apparatus of the invention, the backup roll, which includes a layer or coating of cork or rubber around its outer periphery, is wrapped about with a plurality of wraps of a synthetic resin film. The film is preferably a type which has a tackiness allowing it to stick to itself so that the several wraps about the backup roll 154 cling to each other, and form closely adhering convolutions concentrically formed about the axis of rotation of the roll. In a preferred usage of the apparatus of the invention, an especially useful synthetic resin in the sense of constituting a backup material for the perforating blades 150 may be utilized. In most instances, however, the synthetic resin film which is itself to be perforated by passage through the apparatus of the invention can be used for wrapping the backup roll 154 prior to commencing the actual unwinding and perforating operations.

It should be pointed out that the backup roll 154 will normally be wrapped about by the several convolutions (5 to 25) of synthetic resin film while the backup roll is in its operating position in the main frame 10 as shown in FIGS. 2, 3 and 4. The wraps of synthetic resin film about the backup roll are accomplished by simply feeding the covering film to the backup roll from a supply roll, which may be a source mill roll, and then manually wrapping the first few turns so that the leading edge is under at least one wrap, and then continuing to revolve the backup drum until a sufficient number of turns of the film are laid up tightly on the backup drum.

Prior to commencing operation of the apparatus of the invention, the backup roll is locked down firmly in position where its outer periphery is in tangential rolling contact with the cutter roll by tightening down the tension screws 162 by means of the handles 164 carried at the top thereof. The tightening down of the tension screws is effected alternately so that substantially equal compression is applied to the backup drum shaft 156 at the opposite ends thereof, and the backup roll bears with equal force against the cutter roll 142 over the entire contact area between these rolls.

With the film perforating assembly prepared and mounted in the main frame 10 in the manner described, the next operation in preparing the apparatus for use can be the positioning of the product roll assembly 190 at the location within the main frame 10 where it is ready to accept film unwound from a source mill roll. In accomplishing this status of the product roll assembly, the power cylinder 222 is actuated to retract the piston rod 220 and cause the cylinder lever 218 to pivot the shaft 214 about its pivotal axis. Pivotation of the shaft 214 causes the swing arms 212 to pivot to a position in which their arcuately slotted upper ends are aligned with the slots or passageways formed between the stop plates 228 and the product roll guide plates 210. In this status of the swing arms 212, a product roll assembly, as hereinbefore described, may be mounted between the upper ends of the swing arms. This will entail lowering an empty cylindrical roll core 200 surrounding a cylindrical sleeve 196 mounted on a shaft 192 into position between the upper ends of the swing arms. The shaft bearings 194 carried at the ends of the shaft 192 will fit within the arcuate slots 213 formed at the upper ends of the swing arms 212, and in this position, the product roll assembly 190 is ready to be moved into its operating position.

It should be pointed out that the type of cylindrical roll core 200 which is utilized in the product roll assembly may vary according to the type of product roll which it is desired to form. Thus, cylindrical roll cores 200 of varying length may be pressed over the cylindrical sleeve 196 and secured firmly in a centered position along this sleeve by means of cardboard spacer sleeves 202 cut to length to fit between the ends of the cylindrical roll core and the spring biased retainer keys 198. The spring biased retainer keys 198 will, or course, permit the cylindrical roll cores 200, and any spacer sleeves 202 which are used, to be telescoped over the cylindrical sleeve 196, since the retainer keys can be depressed into slots formed in the clyindrical sleeve against the bias of their respective springs to permit the roll core and spacer sleeves to slide over the cylindrical sleeve.

With an empty product roll assembly 190 supported between the upper ends of the swing arms 212 in the manner described, the power cylinder 222 is acutated to extend the piston rod 220 which effects the pivotation of the swing arm shaft 214 in a clockwise direction as this shaft is viewed in FIGS. 2 and 4. Rotation of the shaft 214 in this direction causes the upper ends of the swing arms 212 to move toward the power roll 172. This movement is continued until the outer peripheral surface of the cylindrical roll core 200 in the product roll assembly 190 bears against the outer peripheral surface of the power roll 172. This status is best illustrated in FIGS. 2 and 4. It will thus be perceived that in this operating relationship between the power roll 172 and the cylindrical roll core 200 carried in the product roll assembly, the cylindrical roll core and the cylindrical sleeve 196 upon which it is mounted are driven in rotation from the power roll. It will be perceived in referring to FIG. 2 that the power roll 172 is driven in the opposite direction from the cylindrical sleeve 196 and roll core 200 of the product roll assembly when the product roll assembly is driven by a frictional contact with the power roll.

With the product roll assembly 190 in its operative position in which the cylindrical roll core is drivingly engaged with the power roll 172, a mill roll can next be positioned in its unwinding or feed position. An important feature of the present invention is the ability of the apparatus to accommodate and automatically feed a plurality of mill rolls to the unwinding and perforating portions of the apparatus mounted on the main frame 10. In most devices used for unwinding and perforating mill rolls as known to the prior art, the mounting of the mill roll within the framework has been accomplished manually, and it has been necessary to manually mount each successive mill roll in its feed position.

As shown in FIGS. 1–4 of the drawings, the mill roll supply frame 50 is provided in association with the main frame 10 and functions to support and to feed by gravity to the mill roll pickup and feeder assembly 70, a plurality of mill rolls which, for convenience of reference, have been referred to as A, B, C and D and E in the figures of the drawing. For clarity, the mill roll A from which a synthetic resin film is being unwound for purposes of perforation and packaging on a product roll has been shown in solid lines in FIG. 2 of the drawings, and the stand-by or reserve mill rolls B–E which are subsequently to be unwound are shown in dashed or broken lines.

In preparing to operate the apparatus for unwinding the film from one of the mill rolls, a series of mill rolls are placed on the mill roll supply frame 50 which is inclined so that the mill rolls move by gravity toward the main frame 10. The opposite ends of the mill rolls bear against the upwardly extending flanges of the roll guiding plates 64, and these plates may be adjusted in their spacing from each other to accommodate mill rolls of varying length. It will also be noted that the slope of the supporting angle plates 62, and of the roll guiding plates 64 with respect to the horizontal can be adjusted by adjusting the supporting feet 54 within the posts 52, and also by the adjustment afforded by the adjusting bolts 68 bearing against the underside of the slope adjusting angle plates 66.

The leading mill roll moves down the inclined upper side of the mill roll supply frame 50 until it reaches the end of this frame over the main frame 10. It should be pointed out that at this time, the flexible braking panel 136 will be positioned, by reason of pivotation of the brake arms 122 of the drag brake assembly, so that the bight or catenary which is not so deep as that shown in FIGS. 2 and 4 of the drawing exists therein. The leading mill roll will roll off of the end of the mill roll supply frame 50 into contact with the flexible braking panel 136, and will be retained in a position where it is actually spaced downwardly by a slight distance from its unwinding position depicted in FIGS. 2 and 4 of the drawings. At this time, prior to start-up and final positioning of the leading mill roll, the air chuck subassembly 72 of the mill roll pickup and feeder assembly 70 is in a retracted, inoperative status. In this status, the air cylinders 96 are not actuated, and the return springs 92 acting against the stops 94 have forced the spring shafts 96 outwardly with respect to the bearing blocks 78 in which they are slidingly mounted. This has resulted in a movement of the locking plates 88 and each of the associated air chuck subassemblies 72 outwardly on the main frame 10 or, stated differently, in a direction toward the respective adjacent channel members 38 and 40. This movement of the locking plates 88 has the effect of causing concurrent movement of the roll supporting shafts 80 engaged by each of the locking plates 88 in a laterally outward direction, so that the spinner assemblies 74 carried on the inner ends of each of the roll supporting shafts 80 are also moved outwardly, or farther apart from each other. Thus, in the pre-operating status, the spinner assemblies will always be spaced horizontally from each other by a distance which is greater than the overall length of the mill roll which is to be moved into the unwinding operative status.

It should be here pointed out that movement in an axial direction of the roll supporting shafts 80 is controlled by movement of the locking plates 88. Therefore, in instances where an especially long mill roll is to be picked up and moved to the operating position by the mill roll pickup and feeder assembly 70, it may be desirable to loosen the set screws 90 by which the shafts 80 are engaged by the locking plates 88, and to slide the roll supporting shafts 80 outwardly with respect to the locking plates or, stated differently, with resepct to each other. In this way, such longer mill rolls can be accommodated.

When the spacing between the spinner assemblies 74 carried by the shafts 80 is such as to afford clearance with respect to the opposite ends of the mill roll to be unwound, then the set screws 90 are retightened so that the roll supporting shafts will again move with the locking plates 88 when they are actuated. It will be apparent that an adjustment of the relative positions between the mill roll supporting shafts 80 in the opposite direction so as to bring them closer to each other, and the spinner assemblies 74 carried on the ends thereof also closer to each other, can be easily accomplished in those instances where relatively short length mill rolls are to be picked up by the mill roll pickup and feeder assembly 70. As will be hereinafter explained, this simple adjustability of the relative positions of the roll supporting shafts 80 and the spinner assemblies 74 carried on the ends thereof provides a marked advantage over film unwinding and perforating devices of the type previously utilized, and enables the apparatus of this invention to accommodate a great variety of sizes of mill rolls without the necessity for dismantling or disassembling various parts of the apparatus in a time consuming and difficult fashion, which has been characteristic of prior art devices.

With the leading mill roll A positioned in the location previously described and the mill roll pickup and feeder assembly 70 in its stand-by, inoperative position where the spinner assemblies 74 carried on the ends of the roll supporting shafts 80 are spaced relatively widely from each other by reason of the actuation of the locking plates 88 by the return springs 92, the lead mill roll A may then be picked up and moved into its unwinding position by closing a valve (not shown) for the purpose of delivering air to the air cylinders 96 forming a portion of each of the air chuck subassemblies 72. As the air cylinders 96 are actuated, the piston rods 98 are extended and force the locking plates toward each other (inwardly on the frame) and place the return springs 92 in compression. Movement of the locking plates 88 toward each other also causes the roll supporting shafts 80 to be reciprocated toward each other and causes the spinner assemblies 74 to converge. The alignment of the spinner assemblies 74 with each other and with the hollow central core of a mill roll to be picked up and moved into the unwinding position is such that the small end of the frusto-conical spinner cone 100 forming a portion of each of the spinner assemblies 74 will move into the open end of the adjacent mill roll core or spindle. The manner in which this comes about may be perceived by reference to FIG. 9 of the drawings, where such a mill roll core or sleeve is depicted and is designated by reference numeral 260.

At this time (that is, at the instant of initial converging movement of the spinner assemblies 74 toward each other), the axis of rotation of the spinners 102 forming a portion of each spinner assembly 74 is not aligned with the longitudinal axis of the mill roll core but, instead, is spaced vertically above this axis. The wedging action of the frusto-conical spinner cones 100, however, forces the core of the mill roll upwardly so that the leading mill roll A from the mill roll supply frame 50 is bodily lifted vertically and slightly toward the left as the unwinding mill roll A is shown in its operative position in FIGS. 2 and 4 of the drawings.

As the air chuck subassemblies 72 are actuated by passage of air to the air cylinders 96 in the manner described, the convergent reciprocating movement of the roll supporting shafts 80 also results in an inward movement of the mill roll stop structure 76 which is carried on one of the shafts 80. This movement causes the stop pin 110 forming a portion of the mill roll stop structure 76 to move inwardly on the main frame 10 and thus to bear over a greater portion of the length of the pin against the peripheral surface of the mill roll B, constituting the second roll being fed to the apparatus from the mill roll supply frame 50. The displacement of the leading mill roll A into its operating or unwinding position by actuation of the air chuck subassemblies 72, and the concurrent arresting of further feeding movement of the mill roll B by the obstruction afforded by the stop pin 110, places the apparatus in an operating status except for the threading of the film through the apparatus.

The manner in which a film F is threaded through the apparatus may be best perceived by reference to FIGS. 2 and 4 of the drawings. Thus, the film F is led off of that side of the operatively positioned lead mill roll A which is nearest the next following mill roll B, and is drawn downwardly to pass around the underside of the cutter roll 142. The film is then led back across the top of the cutter roll between this roll and the backup roll 154. The film is then led across the top of the backup roll and over the top of the power roll 172. The film F is directed downwardly between the power roll and the cylindrical roll core 200 of the product roll assembly 190, and is brought back around the cylindrical roll core, over the top thereof and is directed downwardly so that the film wraps upon itself as the cylindrical roll core 200 is rotated in a clockwise direction (as viewed in FIG. 2) by its frictional engagement with the power roll 172. Threading of the film F to be perforated and wound in a product roll through the apparatus in the manner described is accomplished manually until one or two wraps are taken around the cylindrical roll core 200 of the product roll assembly 190. It will be noted that in this winding status, counterclockwise rotation of the power roll 172 will result in (a) clockwise unwinding rotation of the mill roll A, (b) clockwise rotation of the cutter roll 142, (c) counterclockwise rotation of the backup roll 154, and (d) clockwise rotation of the cylindrical roll core 200 of the product roll assembly 190.

With the film threaded in the manner described, the braking torque which is to be applied to the mill roll A as it is unwound is adjusted by hanging a predetermined amount of weight from the serrated teeth 130 formed in the hand lever 126 of the drag brake assembly 116. It will be perceived that weighting the hand lever 126 at this point causes its pivotation about the longitudinal axis of the drag brake shaft 120 so that the brake arms 122 are pivoted upwardly, thereby increasing the tension in the flexible braking panel 136 and thus increasing the drag exerted by this panel on the outer periphery of the unwinding mill roll A. As the hand lever 126 and its associated weight pivot downwardly, the braking moment exerted thereby changes, but this change is offset by the increasing braking moment exerted by the counter-balance weight 123.

I have determined that the novel drag brake assembly 116 constituting a portion of the apparatus of the present invention functions much more effectively for applying a desired, compensating braking force to the mill roll during the unwinding thereof than the types of braking systems heretofore used. Generally, such braking systems have attempted to brake a shaft upon which the mill rolls were mounted for rotation with such shafts, and the changing weight and momentum of the unwinding mill rolls has not been properly constantly compensated by such constantly applied braking force to the rotating shaft to assure smooth and even drag and tension in the unwinding film as the diametric size of the mill roll diminishes. By developing the braking force in the present invention through the application of a frictional drag exerted on the outer periphery of the unwinding mill roll, I have found that a more effective braking force is developed which automatically undergoes a correlated variation as the diametric size of the mill roll diminishes during winding, and which therefore assures a more constant tensioning of the film as it is pulled through the apparatus and wound up upon the cylindrical roll core of the product roll assembly 190.

Thus, as the diameter of the unwinding mill roll decreases, it will be seen in referring to FIG. 2 of the drawing that the area of the outer peripheral surface of the mill roll which is contacted by the flexible braking panel 136 will continuously decrease. With this decreasing area of contact, the frictional drag exerted by the braking panel 136 decreases, and this is appropriate and advantageous since, at this time, the inertia of the mill roll becomes less since its mass is decreasing. In other words, when the mill roll is large in diameter it is quite heavy and, though it does not rotate so fast at this time, it nevertheless tends to develop a very considerable momentum and, is at this time more appropriately contacted by a larger area of contact of the flexible braking panel 136 than when it has become unwound considerably and its diameter has been decreased.

It will further be noted that the actual tension which is developed in the braking panel 136 is maintained relatively constant because, while the pivotation of the hand lever 126 downwardly decreases the leverage exerted by weights hung thereon, and thus tends to decrease the tension in the flexible panel 136, this decrease of the lever arm and tendency to decrease the tensioning of the panel is offset or compensated by the concurrent pivotation of the counterbalance shaft 121 and counterbalance weight 123 in a direction such that the leverage exerted here is increasing, thus offsetting or counteracting the decrease in such leverage as occurs through the downward pivotation of the hand lever 126. Thus, constant tensioning of the braking panel 136 is achieved, and the only difference in its braking capability which may occur is that experienced as a result of the slightly lower frictional drag which the panel exerts against the outer peripheral surface of the mill roll late during the unwinding operation after the area of contact has been decreased by a decrease in the diameter of the mill roll.

It should be pointed out that the ability to use a drag brake assembly 116 of the type described is in part due to the manner in which I support the unwinding mill roll in the main frame 10 of the apparatus. Thus, instead of utilizing a rotating shaft mounted in bearings at opposite ends of the framework for supporting the unwinding mill roll, and having the mill roll keyed thereto so that both the shaft and mill roll rotate concurrently, I employ dead shafts with the spinners 102 of the spinner assemblies 74 rotatably mounted on the shafts 80 which do not themselves rotate. This construction also facilitates the use of the air chuck subassemblies 72 which allow adjustment of the relative positions of the two roll supporting shafts 80 by the mere removal of the set screws 90, and readjustment of the location of these shafts, in beneficial contrast to extensive dismantling and remounting procedures which have been entailed in prior assemblies in which a live shaft carrying the mill roll for rotation therewith has been utilized.

In some instances, it will be desirable, because of the character of the film being passed through the apparatus, and also because of a desire to apply a greater braking force to the unwinding mill roll at a time near the end of the unwinding operation, to apply the braking force manually. For this purpose, the hand grip 128 is provided on the end of the hand lever 126, and by pressing down on the hand grip, a more sensitively controlled braking force can be applied through a selected increase in the tension in the flexible braking panel 136.

With the apparatus in the invention in a readiness status for commencing the unwinding of the mill roll, the motor 48 is started. The motor 48 is preferably a variable speed motor so that a selected unwinding speed can be used in order to increase the overall flexibility of the apparatus, and to permit different types of mill rolls and different types of film to be better accommodated by the ability to select different speeds of unwinding the film from the mill roll. With actuation of the motor 48, the power roll 172 is driven in rotation from the pulley 180 which is engaged by the belt 182. Rotation of the power roll 172 causes the cylindrical roll core 200 to be driven by reason of frictional engagement therewith, and the cylindrical sleeve 196 and shaft 192 also undergo rotation. As the cylindrical roll core 200 rotates, the film is wrapped thereon and the product roll is built. As the film is wrapped upon the cylindrical roll core 200, the film is unwound from the mill roll A by the exerted tension. As the film passes over the cutter roll 142 and the backup roll 154, these rolls are also driven in rotation.

It will be perceived in referring to FIGS. 2 and 5 that each rotation of the cutter roll 142 brings the aligned cutting edges of the perforating blades 150 into contact with the film at the point where it passes between the periphery of the cutter roll and the periphery of the backup roll. At this time, the serrated outer edges of the perforating blades 150 cause a transverse line of perforations to be formed extending completely across the film in a transverse direction. By continued rotation of the cutter roll 142, and the passage of the film between this roll and the backup roll 154, there are thus formed a series of longitudinally spaced, transversely extending perforation lines in the synthetic resin film, and these lines define between them a sheet of the film which will be detached at such time as the ultimate user elects to sever one of the subdivided sheets from the remainder of the roll of film on the product roll.

It is desirable, from the standpoint of marketing of the product rolls and to prevent wastage, to know as precisely as possible, the total number of sheets which are formed in the total length of synthetic resin film wound up in the product roll. To allow an accurate count to be made of the number of sheets in the film, the sheet counting assembly 238 of the present invention is provided.

In prior types of synthetic resin sheet unwinding and perforating apparatus of the general type constituted by the present invention, an approximation of the number of sheets in the product roll has been obtained by providing a mechanical counter kinematically interconnected with a shaft upon which the product roll is mounted. A count is registered by such a counter for each revolution of the product roll shaft. The count of the number of sheets in the product roll, when this method is employed, can only be an approximation of the total number of perforated sheets in the product roll, since the number of sheets taken up in the product roll will obviously be a greater number for each revolution of the roll as the diametric size of the product roll increases. Thus, more of the sheets are included in each wrap around the product roll as the product roll becomes larger, and to establish a direct correlation between the number of sheets counted and the number of revolutions of the product roll shaft cannot provide an accurate final total count. The sheet counting assembly 238 of the present invention eliminates the described inaccuracy in the total count by counting in an accurate fashion, the number of revolutions of the cutter roll 142 which the cutter roll undergoes from the time of commencement of unwinding of the mill roll, until completion of the building of the product roll. Each revolution of the cutter roll 142 accomplishes, as previously explained, one transverse perforation of the synthetic resin film, and it will be further apparent that the total number of sheets in the synthetic resin film is only one greater than the total number of revolutions of the cutter roll.

The ability to count the number of sheets directly from the rotative movement of the cutter roll 142 is accomplished by the use of a strategically located photocell 242 within the photocell housing 240. The photocell 242 is here positioned so that it is in direct alignment with one end face of cutter roll 142. At an appropriate location in radially spaced relation to the rotational axis of the cutter roll 142, a spot or tab of light reflective or light sensitive material is mounted on the end face of the cutter roll, and during each revolution of the cutter roll, this spot or tab comes into alignment with the photocell. This results in an actuation of the photocell and the development of a read out pulse which is transmitted through the electric leads 244 to the counter device 246. Thus, upon each revolution of the cutter roll 142, one count is registered by the counter device. This device is mounted in a location where it is easily visible to the operator of the apparatus, so that should a desired or specific number of sheets be desired in a given product roll, the variable speed motor 48 can be reduced in speed, and hand braking appropriately applied through the drag brake assembly 116 to place almost precisely the desired number of sheets in the product roll to be formed. Stated differently, unwinding of the mill roll can be terminated at a time when less than all of the film is unwound and perforated, but a precise number of sheets are provided in that portion of the film which is perforated, and which is wound into the product roll.

Auxiliary Sub-Systems

In addition to the primary assemblies and subassemblies used in the winding and perforating apparatus of the invention for performance of the basic functions of the machine, certain sub-systems are provided which perform an auxiliary function utilized on some occasions for certain specialized applications of the equipment. Thus, for example, it is sometimes desirable to concurrently unwind a pair of relatively short mill rolls, and to extend the sheets of synthetic resin film thus originating through the apparatus for concurrent perforation and concurrent building of two product rolls. The apparatus shown in FIG. 9 can be used to facilitate the carrying out of this operation.

Thus, in FIG. 9, there is shown in use, in conjunction with one of the spinner assemblies 74 forming a part of the mill roll pickup and feeder assembly 70, a center spinner assembly designated generally by reference numeral 250. The center spinner assembly 250 includes a relatively short shaft 252 which carries a center spacer washer 254 located substantially midway of its length. Rotatably mounted on the shaft 252 are a pair of generally cylindrical sleeves 256, each of which is provided with a flared end hub 258.

As shown in FIG. 9, the center spinner assembly 250 is used for splicing or interconnecting a pair of mill roll cores or spools 260 and 262. Not shown in FIG. 9 is, of course, a spinner assembly 74 disposed at the opposite end of the right hand mill roll core 262 for the purpose of supporting that mill roll core in the same manner as the mill roll core 260 is supported at one end by the illustrated spinner assembly 74. With the roll splicing arrangement illustrated, and using the center spinner assembly 250 in the manner shown, a pair of relatively short mill rolls mounted upon the relatively short mill roll cores 260 and 262 can be placed in the unwinding position shown in FIGS. 2 and 4 of the drawings, in place of the single mill roll A which is there illustrated. It will be noted that the described arrangement will permit each of the mill rolls mounted upon the mill roll cores 260 and 262 to rotate independently of the other relatively short mill roll, so that uneven tensions exerted in the synthetic resin films, or other uneven forces, will be applied to the individual and independently rotatable mill rolls, and the mill rolls will not be forced to turn at the same speed, as would be the case if they were mounted upon a common shaft for concurrent rotation therewith. It follows from this description of the manner in which the two independent mill rolls are unwound that, in such usage, it would be desirable to provide a pair of the flexible braking panels for friction braking purposes, with each of such panels operating individually on a separate one of the unwinding mill rolls, rather than a single braking panel 136 of the type shown in FIGS. 1, 2 and 4.

In conjunction with the use of a pair of unwinding, relatively short mill rolls, it will be necessary to provide two different product roll cores for building two separate product rolls, instead of using merely a single cylindrical roll core 200 of the length shown in FIG. 8 of the drawings. In such case, it is only necessary to provide two cylindrical roll cores axially aligned with each other on the cylindrical sleeve 196, and spaced from each other by a suitable cardboard spacer or the like positioned in the center of the cylindrical sleeve. Two strips of synthetic resin film are then wound individually upon the two cylindrical roll cores thus provided. Another possible arrangement for building two product rolls from two individual, independently unwound mill rolls mounted in the manner shown in FIG. 9 will be hereinafter described.

Figure 12:
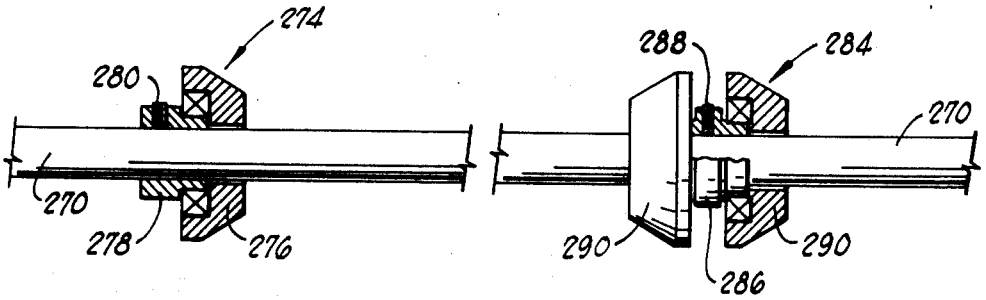
FIG. 12 is a detail view, with parts shown in elevation and parts shown in section, illustrating the manner in which two short length cylindrical roll cores of the product roll assembly are mounted in the apparatus for simultaneous formation of two product rolls from the unwinding of two short length mill rolls as shown in FIG. 9.
Figure 7:
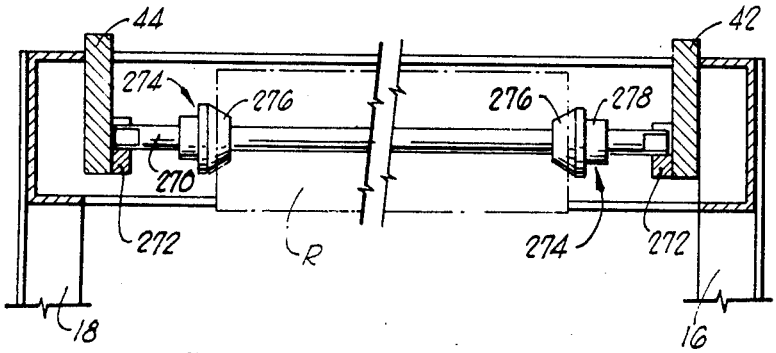
FIG. 7 is a vertical sectional view taken along line 7—7 of FIG. 4.

Another auxiliary system which can be usefully provided in the apparatus of the present invention is illustrated in FIGS. 4, 7 and 12. This system may be referred to as a stand-by or reserve feed roll system. The function of this system is to permit a reserve or stand-by roll to be readily available in a position where the film wound thereon can be used for quickly and easily wrapping such film upon the outer periphery of the backup roll 154 to provide the unique outer peripheral covering material in the manner hereinbefore described. A stand-by mill roll can also be used at this location to actually feed a particular type of synthetic resin film through the perforating apparatus, and to a product roll, from an alternate location, instead of from the normal feed position occupied by mill roll A as shown in FIGS. 2 and 4. Such an operation is sometimes desirable in cases where the mill roll supply frame is completely and totally loaded with mill rolls carrying a certain type of film, and it becomes desirable or necessary to quickly fill an order for product rolls carrying a different type of film. In this event, rather than completely unloading the heavy mill rolls from the mill roll supply frame 50 in order to place the mill roll carrying the special type of film in position for unwinding from the normal unwinding position, the mill roll of special film could be placed in the reserve or stand-by status, and the film therefrom fed through the apparatus for perforation and building of the custom product roll without the necessity for completely unloading the mill roll supply frame.

The stand-by or reserve mill roll (or roll of backup roll covering film) is positioned in a location between the trapezoidally shaped, roll supporting plates 42 and 44 beneath the inner end of the mill roll supply frame 50. The reserve roll of film, which is designated by the reference letter R in FIG. 7, is mounted upon an elongated shaft 270 which has flats formed on the opposite ends thereof, which shaft ends slip into slotted brackets 272 secured to the inner sides of the roll supporting plates 42 and 44. The flats on the end of the shaft 270, in conjunction with the size of the slots in the brackets 272, prevent rotation of the shaft about its axis when it is mounted in the brackets. Carried rotatably on the shaft inwardly from its ends are a pair of axially spaced hub assemblies, designated generally by reference numeral 274. Each hub assembly 274 includes a frustoconical spinner element 276 which is rotatably mounted upon a hub 278 secured by a set screw 280 to the shaft 270. Using a pair of the hub assemblies 274 constructed as thus described, the stand-by or reserve mill roll R can be rotatably mounted on the shaft 270, and the film carried thereon can be fed thereafter from the reserve mill roll, around the cutter roll 142, and through the apparatus in the same manner as in the case of film derived from a mill roll located in the primary operating position. The film from the reserve mill roll R is wound up in a product roll in the same manner as previously described, or it may be a special type of film held in reserve at the described location for use essentially in the provision of the wraps of film around the outer periphery of the back-up roll.

In the event that it is desired to unwind a pair of relatively short mill rolls from the stand-by position, this can be accomplished by the use of a splicing hub assembly 284 of the type shown in FIG. 12. Here, the splicing hub assembly 284 is mounted at the center of the shaft 270, and includes a central hub 286 keyed to the shaft 270 by means of a set screw 288. The central hub has rotatably mounted on the opposite sides thereof, a pair of spinner elements 290 similar to the spinner element 276 of the hub assembly 274. It will be perceived that by the use of the central hub assembly 284 and a pair of the hub assemblies 274, a pair of mill rolls of varying lengths can be accommodated on the shaft 270 in a stand-by or reserve position, and can be concurrently unwound in an independent fashion, without the rate of unwinding of one of the mill rolls affecting the rate of unwinding of the other of the two mill rolls.

From the foregoing description of the invention, it will have become apparent that the present invention provides a highly flexible, very easily used film winding and perforating apparatus which can be used to quickly and easily, and with a minimum of manual effort, form one or more product rolls of synthetic resin film, after such film has been perforated evenly to subdivide it into a plurality of contiguous sheets, Although certain specific structural elements have been identified, and their function described in considerable detail, it will be understood that the portrayal and associated description of certain preferred embodiments of the apparatus of the present invention, as set forth herein, is not intended to limit the invention to the precise structures shown and described. Rather, various equivalent structures, or alternate structures which perform equivalent functions, can be incorporated in the apparatus, and various of the novel and highly useful subassemblies can be replaced by conventional subassemblies, without destroying the overall novelty of the apparatus, or detracting completely from the improved results afforded by various novel structures and basic principles which underlie the present invention. Changes and innovations of this type are therefore deemed to be circumscribed by the spirit and scope of the invention except as the same may be necessarily limited by the appended claims, or reasonable equivalents thereof.

What is claimed is:

1. Film winding and perforating apparatus comprising:

a frame;

means for positioning a mill roll on the frame in an unwinding position wherein said positioning means comprises:

a pair of air chuck subassemblies positioned on opposite sides of said frame, each of said air chuck subassemblies including a horizontally extending roll supporting shaft horizontally reciprocable upon actuation of the respective air chuck subassembly;

spinner assemblies mounted on one end of each of said roll supporting shafts with said spinner assemblies facing each other and positioned for engaging opposite ends of a mill roll;

a mill roll supply frame for sequentially feeding a plurality of mill rolls to a position where one of said mill rolls can be engaged by said spinner assemblies upon actuation of said air chuck assemblies;

means for manually adjusting the horizontal spacing between said spinner assemblies; and mill roll stop structure connected to said roll supporting shafts for arresting movement of selected mill rolls on said mill roll supply frame when said air chucks are actuated to engage said leading mill roll with said spinner assemblies;

means for winding film from the mill roll upon a product roll;

means for guiding film from the mill roll through a predetermined path to the product roll;

means along said predetermined path for scoring the film with transverse perforation lines;

a flexible drag brake sheet positioned to cradle, and bear against, a portion of the outer peripheral surface of said mill roll; and means for supplying constant tension to said flexible drag brake sheet to maintain substantially constant, the force with which said drag brake sheet bears against the outer peripheral surface of said mill roll, said drag brake sheet being positioned across said mill roll adjacent the outer periphery thereof so that, as the diameter of the mill roll decreases with unwinding, the area of contact of the drag brake sheet against the outer peripheral portion of the mill roll gradually decreases, whereby the tension in the film being unwound from said mill roll is retained relatively constant at all times.

2. Film winding and perforating apparatus as defined in claim 1 and further characterized as including vertically extending channel members secured to said frame and each having one of said air chuck assemblies mounted thereon, each of said air chuck assemblies comprising:

a bearing block secured to the respective vertically extending channel member;

at least one air cylinder mounted on said bearing blocks;

said bearing block having a plurality of bores therethrough, with one of said roll supporting shafts extending slidingly through one of said bores;

a locking plate adjustably secured to the respective roll supporting shaft;

a piston rod projecting from said air cylinder parallel to said roll supporting shaft and secured to said locking plate; and spring means for retracting said locking plate upon de-energization of said air cylinders.

3. Film winding and perforating apparatus as defined in claim 2 wherein each of said spinner assemblies includes:

a frusto-conical spinner cone secured to the respective roll supporting shafts; and a frusto-conical spinner supported on the respective roll supporting shaft adjacent said spinner cone for rotation about the axis of the respective roll supporting shaft.

4. Film perforating and winding apparatus as defined in claim 1 wherein said mill roll supply frame includes an upper side having a plurality of roll supporting plates inclined to the horizontal to facilitate the gravitational feeding of mill rolls from said mill roll supply frame to said main frame; and roll guiding plates extending parallel to said roll supporting plates and having upwardly projecting flanges for engaging the opposite ends of mill rolls moving on said mill roll supply frame and thereby guiding said mill rolls toward said main frame.

5. Film winding and perforating apparatus as defined in claim 4 and further characterized as including:

means for adjusting the angle at which said roll supporting plates extend to the horizontal; and means for adjusting the horizontal spacing between said roll guiding plates.

6. Film winding and perforating apparatus comprising:

a frame;

means for positioning a mill roll on the frame in an unwinding position;

means for winding film from the mill roll upon a product roll;

means for guiding film from the mill roll through a predetermined path to the product roll;

means along said predetermined path for scoring the film with transverse perforation lines; and a flexible drag brake sheet positioned to cradle, and bear against, a portion of the outer peripheral surface of said mill roll; and means for applying constant tension to said flexible drag brake sheet to maintain substantially constant, the force with which said drag brake sheet bears against the outer peripheral surface of said mill roll, said drag brake sheet being positioned across said mill roll adjacent the outer periphery thereof so that, as the diameter of the mill roll decreases with unwinding, the area of contact of the drag brake sheet against the outer peripheral portion of the mill roll gradually decreases, whereby the tension in the film being unwound from said mill roll is retained relatively constant at all times, said tension applying means further including:

a first brake rod mounted in said frame and having one end of said drag brake sheet attached thereto;

a second brake rod spaced from said first brake rod and extending substantially parallel thereto, said second brake rod having the other end of said flexible drag brake sheet attached thereto;

a pair of arms secured to said second brake rod and projecting normal thereto;

a drag brake shaft extending substantially parallel to said brake rods, and having its opposite ends pivotally supported in said frame and having said brake arms keyed thereto;

a hand lever having one end secured to a central portion of said drag brake shaft, and projecting substantially normal thereto in a horizontal direction; and counterbalance means projecting from said drag brake shaft in a direction substantially normal to the axis of said shaft and to the plane of said hand lever for counterbalancing the downward movement of said hand lever during the operation of the film winding and perforating apparatus.

7. Film winding and perforating apparatus as defined in claim 6 wherein said means for applying constant tension is further characterized by:

teeth formed along the upper side of said hand lever on the opposite side of said drag brake shaft from said second brake rod;

a hand grip secured to the opposite end of said hand lever from said drag brake shaft; and means for adjustably mounting said first brake rod in said frame whereby the configuration of a portion of said drag brake sheet cradling said mill roll may be selectively adjusted by movement of said first brake rod.

8. Film winding and perforating apparatus comprising:

a frame;

means for positioning a mill roll on the frame in an unwiding position wherein said positioning means comprises:

a pair of horizontally spaced, horizontally extending, aligned roll supporting shafts mounted in said frame for horizontal reciprocation;

means mounted on one end of each of said roll supporting shafts and positioned for engaging opposite ends of a mill roll;

means for manually adjusting the horizontal spacing between said mill roll engaging means;

a mill roll supply frame for sequentially feeding a plurality of mill rolls to a position where one said mill rolls can be engaged by said mill roll engaging means when said roll supporting shafts are moved toward each other; and mill roll stop structure connected to said roll supporting shafts for arresting movement of selected mill rolls on said mill roll supply frame when said roll supporting shafts are moved to a position of engagement of said mill roll engaging means with the leading mill roll on said mill roll supply frame;

means for winding film from the mill roll upon a product roll;

means for guiding film from the mill roll through a predetermined path to the product roll;

means in said predetermined path for scoring the film with transverse perforation lines;

a product roll assembly including a cylindrical roll core for receiving film to form a product roll; and a swing arm shaft assembly removably carrying said product roll assembly to facilitate removal of said product roll assembly upwardly from said winding and perforating apparatus.

9. Film winding and perforating apparatus comprising:

a frame;

means for positioning a mill roll on the frame in an unwinding position;

means for winding film from the mill roll upon a product roll, said means for winding the film upon the product roll comprising:

a power roll rotatably mounted in said frame; means for driving said power roll in rotation; a product roll assembly comprising:

a cylindrical roll core for receiving film to form a product roll; and means for rotatably supporting the cylindrical roll core;

a swing arm shaft assembly removably carrying said product roll assembly to facilitate removal of said product roll assembly upwardly from said winding and perforating apparatus, said swing arm shaft assembly comprising:

spaced arms pivotally mounted in said frame and releasably supporting said means for rotatably supporting said cylindrical roll core; and means for pivoting said arms to a position where said cylindrical roll core bears against said power roll from a position where said product roll assembly is spaced from said power roll and is accessible from above said frame;

means for guiding film from the mill roll through a predetermined path to the product roll;

means along said predetermined path for scoring the film with transverse perforation lines; and means for braking the rate of film travel from the mill roll to the product roll in automatic response to changes in mill roll diameter.

10. Film winding and perforating apparatus comprising:

a frame;

means for positioning a mill roll on the frame in an unwinding position;

means for winding film from the mill roll upon a product roll;

means for moving said product roll from a first position of initial placement in the frame to a second position for receiving film wound thereon from the mill roll, said means for moving the product roll comprising:

a pair of generally vertically extending swing arms mounted on said frame at the opposite sides thereof for pivotation about horizontal axes located below the upper ends of said swing arms, each of said swing arms having an open slot formed in the upper end thereof;

means for pivoting said swing arms about their pivotal axes to move the upper ends thereof through an arc between said first position and said second position; and product roll guide plates secured to said frame and positioned over a portion of the path of movement of the upper ends of said swing arms for retaining a product roll carried by said swing arms in the open slots formed therein against upward movement relative to said frame;

means along said predetermined path for scoring the film with transverse perforation lines; and means for braking the rate of film travel from the mill roll to the product roll.

11. Film winding and perforating apparatus as defined in claim 10 wherein said means for pivoting said swing arms comprises:

a shaft extending across, and pivotally mounted in, said framework and having said swing arms keyed thereto;

a cylinder lever having one end keyed to said shaft for pivotation therewith;

a piston rod connected to the other end of said cylinder lever; and a power cylinder mounted on said framework and having a piston therein connected to said piston rod.

12. Film winding and perforating apparatus as defined in claim 11 wherein said means for scoring the film with transverse perforation lines comprises:

a cutter roll having a slot in the outer peripheral surface thereof extending substantially parallel to the axis of rotation thereof; and a plurality of aligned cutter blades positioned in said slot.

13. Film winding and perforating apparatus as defined in claim 12 wherein said means for braking comprises a flexible drag brake sheet positioned to cradle, and bear against, a portion of the outer peripheral surface of said mill roll.

* * * * *